US007812509B2

(12) United States Patent
Tanaka et al.

(10) Patent No.: US 7,812,509 B2
(45) Date of Patent: Oct. 12, 2010

(54) SPARK PLUG

(75) Inventors: Dai Tanaka, Okazaki (JP); Keisuke Nagakura, Toyota (JP); Shigeo Yamamoto, Obu (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 220 days.

(21) Appl. No.: 11/988,554

(22) PCT Filed: Jul. 14, 2006

(86) PCT No.: PCT/JP2006/314089

§ 371 (c)(1),
(2), (4) Date: Jan. 10, 2008

(87) PCT Pub. No.: WO2007/010867

PCT Pub. Date: Jan. 25, 2007

(65) Prior Publication Data

US 2009/0026910 A1 Jan. 29, 2009

(30) Foreign Application Priority Data

Jul. 15, 2005 (JP) ..... 2005-206903

(51) Int. Cl.
*H01T 13/20* (2006.01)

(52) U.S. Cl. ..... 313/141; 313/118; 313/140; 313/142

(58) Field of Classification Search ..... 313/118, 313/140–142
See application file for complete search history.

(56) References Cited

U.S. PATENT DOCUMENTS 3,965,384 A * 6/1976 Yamazaki ..... 313/142
4,914,343 A * 4/1990 Kagawa et al. ..... 313/139
4,983,877 A * 1/1991 Kashiwara et al. ..... 313/140
5,051,651 A * 9/1991 Kashiwara et al. ..... 313/139
5,189,333 A * 2/1993 Kagawa et al. ..... 313/140
5,581,145 A * 12/1996 Kato et al. ..... 313/141
5,680,002 A 10/1997 Kunitomo et al.
5,736,809 A * 4/1998 Matsutani et al. ..... 313/141
6,060,822 A * 5/2000 Krupa et al. ..... 313/141
6,064,143 A * 5/2000 Kagawa ..... 313/141
6,198,209 B1 * 3/2001 Baldwin et al. ..... 313/141
6,316,868 B1 * 11/2001 Ishino et al. ..... 313/141

(Continued)

FOREIGN PATENT DOCUMENTS

DE 196 27 524 A1 1/1998

(Continued)

*Primary Examiner*—Nimeshkumar D. Patel
*Assistant Examiner*—Thomas A Hollweg
(74) *Attorney, Agent, or Firm*—Birch, Stewart, Kolasch & Birch, LLP

(57) ABSTRACT

A spark plug (10) includes a plug body (51), a center electrode (52), a ground electrode (53) and injection control side poles (61, 62, 63). The ground electrode has an end portion (53*a*) opposing the end of the center electrode in a direction indicated by arrow A parallel to the axis of the plug body. A tip (53*b*) of the ground electrode and a tip (60*a*) of the injection control side poles (61, 62, 63) are positioned in substantially the same plane (71) perpendicular to the axis (C). The ground electrode (53) and the injection control side poles (61, 62, 63) are arranged at substantially regular intervals around the center electrode (52).

4 Claims, 10 Drawing Sheets

U.S. PATENT DOCUMENTS

| | | | | |
|---|---|---|---|---|
| 6,335,587 | B1 * | 1/2002 | Matsubara | 313/141 |
| 6,667,568 | B1 * | 12/2003 | Bugaets | 313/143 |
| 6,796,299 | B2 * | 9/2004 | Isono | 123/627 |
| 6,819,032 | B2 | 11/2004 | Matsubara | |
| 2006/0028107 | A1 * | 2/2006 | Hori et al. | 313/141 |

FOREIGN PATENT DOCUMENTS

| | | | |
|---|---|---|---|
| JP | 104084/1981 | | 8/1981 |
| JP | 192686/1982 | | 12/1982 |
| JP | 4-196080 | A | 7/1992 |
| JP | 8-222352 | A | 8/1996 |
| JP | 9-148045 | A | 6/1997 |
| JP | 9-223570 | A | 8/1997 |
| JP | 2001-110546 | A | 4/2001 |
| JP | 2002-289318 | A | 10/2002 |

* cited by examiner

SPARK PLUG

BACKGROUND OF THE INVENTION

1. Field of the Invention

The present invention relates to a spark plug for use in, for example, a direct-injection engine.

2. Description of the Related Art

In spark plugs for use in, for example, vehicle gasoline engines, a structure incorporating a parallel ground electrode and a plurality of sub ground electrodes has been proposed as a structure for preventing conductive components, such as carbon, from depositing on an insulator.

The parallel ground electrode and sub ground electrodes are provided around a center electrode. Each sub ground electrode opposes the lateral peripheral surface of the center electrode. In the spark plugs of this type, spark discharge occurs between the center electrode and the sub ground electrodes. Spark discharge burns out attached conductive components, such as carbon.

The ends of the parallel ground electrode and sub ground electrodes are not positioned on the same plane (see, for example, Jpn. Pat. Appln. KOKAI Publication No. 2001-110546).

Further, to increase the life duration of the spark plug, a structure including a plurality of ground electrodes has been proposed. In this case, when one ground electrode has worn out due to spark discharge, another ground electrode is used for spark discharge. Thus, the life duration of the spark plug is increased.

The ends of these ground electrodes oppose the side surface of a center electrode. Accordingly, spark discharge between each ground electrode and the center electrode occurs on a plane perpendicular to the axis of the spark plug. Further, the ends of the ground electrodes are positioned on substantially the same plane (see, for example, Jpn. Pat. Appln. KOKAI Publication No. 4-196080).

SUMMARY OF INVENTION

On the other hand, in a spray-guide type engine in which an injector directly sprays fuel to a spark plug, which engine is included in direct-injection engines in which fuel is directly injected into a combustion chamber using an injector, the injected fuel is vaporized to form an appropriate air-fuel mixture near the spark plug. The air-fuel mixture is ignited and combusted. More specifically, the injected fuel collides with the ground electrodes and diffuses, whereby mixing of the fuel with air and vaporization of the fuel are accelerated, and the resultant fuel mixture is concentrated around the center electrode. The thus-concentrated fuel mixture is ignited by the spark plug.

The ignition timing for stably combusting the fuel varies depending upon the concentrated state of the fuel. Namely, the degree of freedom of determining the ignition timing for stably combusting fuel relatively increases or decreases in accordance with the concentrated state of the fuel. The concentrated state of the fuel is varied by the attitude of a ground electrode with respect to the injector.

However, it is difficult to control the attitude of the ground electrode. This point will be described in more detail. The spark plug has a screw portion. When the screw portion is engaged with the cylinder head of the engine body, the spark plug is fixed thereto.

Since thus, the attitude of the ground electrode varies in accordance with the engagement state of the spark plug with respect to the engine body, it is difficult to control the attitude of the ground electrode with respect to the injector.

Further, in multi-cylinder engines, the attitude of the ground electrode with respect to the injector may vary among the cylinders.

When the attitude of the ground electrode with respect to the injector varies among the cylinders, the degree of freedom of determining the ignition timing varies between the combustion chambers.

In this case, the ignition timing employed is determined to be common timing included in the ignition timing range in which fuel is combusted stably in the combustion chambers.

Accordingly, in multi-cylinder engines, the degree of freedom of determining the ignition timing for stably combusting fuel is considered low, which means that it is difficult to stably combust fuel.

To inhibit a change in the concentrated state of fuel due to the attitude of an ground electrode, a plurality of ground electrodes may be employed.

In the spark plug disclosed in the above-mentioned Jpn. Pat. Appln. KOKAI Publication No. 2001-110546, the ends of the parallel ground electrode and sub ground electrodes are not positioned on the same plane. From this, it is considered that the diffusion state of fuel assumed when the injected fuel collides with the parallel ground electrode may differ from the diffusion state of fuel assumed when the injected fuel collides with the sub ground electrodes.

Accordingly, in the spark plug disclosed in Jpn. Pat. Appln. KOKAI Publication No. 2001-110546, the diffusion state of fuel may differ in accordance with the attitude of the spark plug.

Further, in the spark plug disclosed in Jpn. Pat. Appln. KOKAI Publication No. 4-196080, although the ends of the ground electrodes are positioned on the same plane, spark discharge occurs between the ground electrodes and center electrode in a direction that intersects the axis of the center electrode. Therefore, the end of the center electrode is positioned on the same plane as the ground electrodes. In this case, however, when the injected fuel collides with the ground electrodes, it inevitably collides with the center electrode. When the injected fuel collides with the center electrode, the insulation resistance may be disadvantageously reduced to make it difficult to spark discharge.

It is an object of the invention to provide a spark plug capable of stably combusting fuel.

A spark plug according to the invention comprises a plug body, a center electrode, a ground electrode, and at least one injection control side pole. The center electrode is provided on the plug body coaxially with the plug body. The ground electrode is provided on the plug body around the center electrode. The ground electrode has an opposing portion opposing an end of the center electrode along an axis of the plug body. The at least one injection control side pole is provided on the plug body around the center electrode. A tip of the ground electrode on the axis of the plug housing and a tip of the at least one injection control side pole on the axis of the plug housing are positioned on substantially the same plane perpendicular to the axis. The ground electrode and the at least one injection control side pole are arranged at substantially regular intervals around the center electrode.

With the above structure, injected fuel collides with the ground electrode and/or injection control side pole and diffuses, whereby it is concentrated around the center electrode.

Accordingly, the spark plug can be effectively used in, for example, direct-injection spray-guide type engines in which fuel injected from an injector is directly ignited.

Further, since the ground electrode and the injection control side pole are arranged at regular intervals, the diffused state of fuel is prevented from being significantly changed by the attitude of the spark plug with respect to the flow of fuel directed to the spark plug, for example, by the attitude of the spark plug with respect to the injector in the direct-injection spray-guide type engines in which fuel injected from an injector is directly ignited.

As a result, variations in the degree of diffusion of fuel due to changes in the attitude of the spark plug can be suppressed.

In an embodiment of the invention, the spark plug has three injection control side poles.

With this structure, the ground electrode and the injection control side poles are arranged around the center electrode, separate from each other by 90°. This suppresses changes in combustion conditions for fuel due to changes in the attitude of the spark plug.

DETAILED DESCRIPTION OF THE INVENTION

Referring to FIGS. 1 to 9, a spark plug according to a first embodiment of the invention will be described. The spark plug 10 of this embodiment is used for, for example, a reciprocation-type gasoline engine 20 for vehicles. The engine 20 is a multi-cylinder engine of a direct-injection type.

Figure 1:
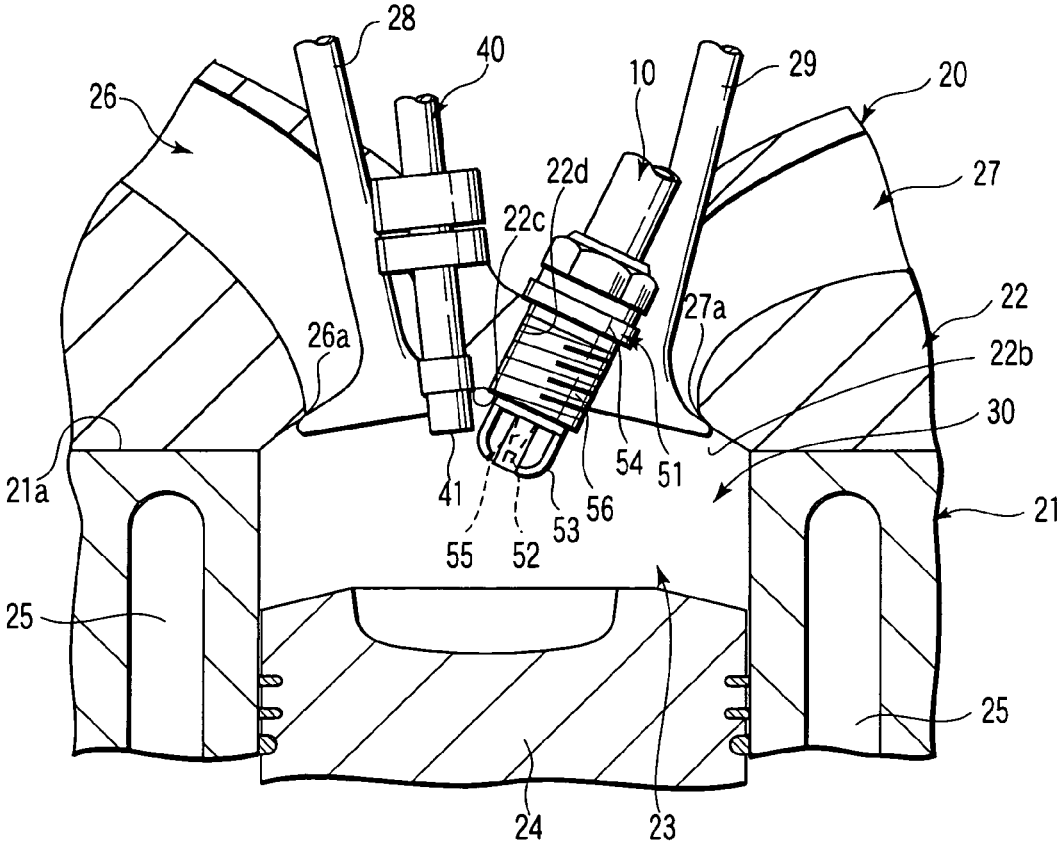
FIG. 1 is a sectional view illustrating the combustion chamber of an engine with a spark plug according to a first embodiment of the invention.

FIG. 1 is a sectional view illustrating the portion of the engine 20 near one combustion chamber 30. As shown in FIG. 1, the engine 20 comprises a cylinder block 21, cylinder head 22, etc.

The cylinder block 21 has a plurality of cylinders 23 formed therein. Each cylinder 23 contains a piston 24. The pistons 24 are connected to a crankshaft (not shown) via respective connecting rods (not shown). The piston 24 is reciprocated within the cylinder 23 by the pressure of combusted gas. The crankshaft is rotated by the reciprocation of the piston 24.

In the cylinder block 21, a water jacket 25 is formed near the cylinders 23. A cooling water is circulated in the water jacket 25.

The cylinder head 22 is fixed to the upper end 21*a* of the cylinder block 21. In the cylinder head 22, the space of the cylinder head 22 communicating with the cylinder 23 is formed as a combustion recess 22*b*. The combustion recess 22*b* is of, for example, a roof shape. The combustion recess 22*b* overlaps the opening of the cylinder 23 that opens through the upper end 21*a*.

The space defined by the combustion recess 22*b*, the outer surface of the piston 24 and inner surface of the cylinder 23 serves as the combustion chamber 30.

The cylinder head 22 has a intake passage 26 and exhaust passage 27 formed therein. An end of the intake passage 26 opens to the combustion recess 22*b*. The opening of the intake passage 26 close to the combustion recess 22*b* serves as a intake port 26*a*. A intake valve 28 is provided at the intake port 26*a*.

An end of the exhaust passage 27 opens to the combustion recess 22*b*. The opening of the exhaust passage 27 close to the combustion recess 22*b* serves as an exhaust port 27*a*. An exhaust valve 29 is provided at the exhaust port 27*a*.

An injector 40 for injecting fuel F and the spark plug 10 are attached to the cylinder head 22. The engine 20 is of a spray guide type in which the spark plug 10 directly ignites fuel F injected from the injector 40.

The injector 40 has an injection port 41. The injector 40 is attached to the cylinder head 22 near the top 22*c* of the cylinder head 22 so that the injection port 41 opens to the combustion recess 22*b* near the top 22*c* of the cylinder head 22.

The spark plug 10 is attached near the top 22*c* of combustion recess 22*b* so as not to interfere the injector 40. In this embodiment, the spark plug 10 is rightwards deviated from the injector 40 in the figure.

The spark plug 10 has a plug body 51, a center electrode 52 (indicated by the broken lines), a ground electrode 53, and a plurality of injection control side poles.

The plug body 51 indicates a portion supported by a member, such as the cylinder head 22, to which the ignition plug 10 is fixed. The plug body 51 is substantially cylindrical.

The plug body 51 comprises, for example, a plug housing 54, a center shaft (not shown), an insulator 55 (indicated by the broken line), etc. The center shaft is contained in the plug housing 54 to guide a current into the plug housing 54. The insulator 55 is contained in the plug housing 54, and partially projects from an end of the plug housing 54.

A screw portion 56 is formed at the end of the plug body 51. The screw portion 56 has a male screw formed thereon. The cylinder head 22 has a female screw portion 22*d* to be screwed with the screw portion 56. The female screw portion 22*d* has a female screw formed therein.

Figure 2:
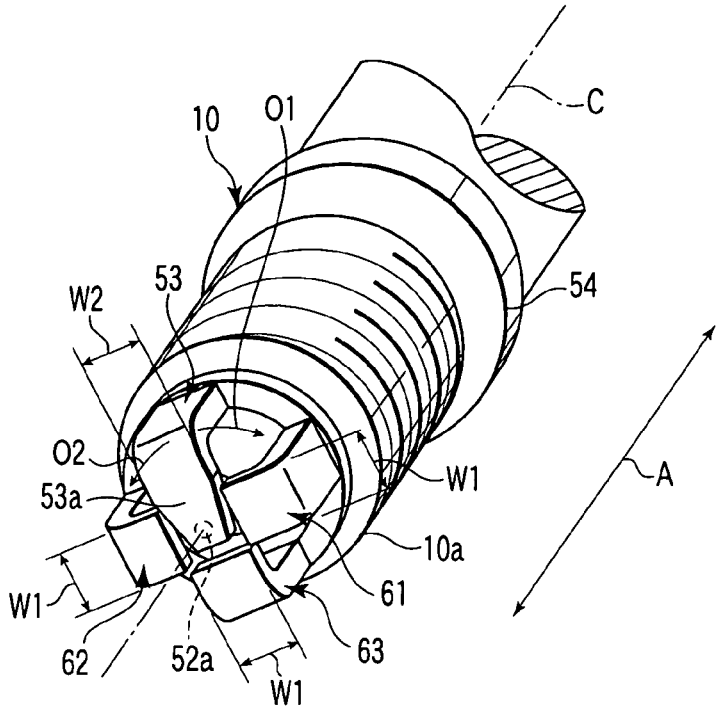
FIG. 2 is a perspective view illustrating the end of the spark plug shown in FIG. 1.

FIG. 2 is a perspective view illustrating the end portion of the plug body 51. The center electrode 52 is housed in the plug body 51. As shown in FIG. 1, the center electrode 52 is surrounded by the insulator 55. As indicated by the broken lines shown in FIGS. 1 and 2, the end portion 52*a* of the center electrode 52 projects from the plug body 51. The center electrode 52 is coaxial with the plug body 51 as indicated by the dotted chain line C.

The ground electrode 53 is attached to the end of the plug body 51. The ground electrode 53 is located around the center electrode 52 and extends along the axis C of the plug body 51.

Figure 3:
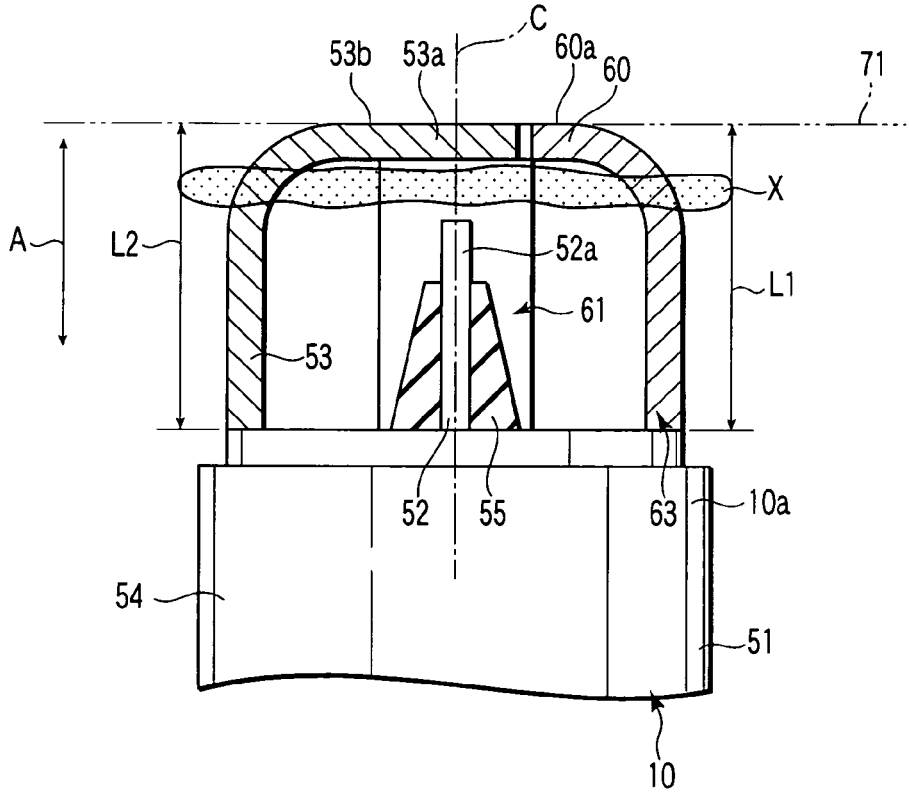
FIG. 3 is a view partly in section, illustrating the end of the spark plug of FIG. 1.

FIG. 3 is a view partly in section, illustrating the end portion 10*a* of the spark plug 10. As shown in FIG. 3, the end portion 53*a* of the ground electrode 53 is radially inwardly angled with respect to the plug body 51, opposing the center electrode 52 along the axis of the plug body 51 as indicated by arrow A. In the invention, the end portion 53*a* of the ground electrode 53 is referred to as an "opposing portion." Spark discharge occurs between the end portion 53*a* of the ground electrode 53 and the center electrode 52.

As shown in FIG. 2, the embodiment employs, as examples of injection control side poles, a first injection control side pole 61, second injection control side pole 62 and third injection control side pole 63.

The first injection control side pole 61 is adjacent to the ground electrode 53 in a clockwise direction O1. The second injection control side pole 62 is adjacent to the ground electrode 53 in a counterclockwise direction O2. The third injection control side pole 63 is positioned between the first and second injection control side poles 61 and 62, and directly opposes the ground electrode 53.

The ground electrode 53, first to third injection control side poles 61, 62 and 63 are positioned around the center electrode 52 with regular intervals. Namely, the ground electrode 53, first to third injection control side poles 61, 62 and 63 are positioned around the center electrode 52 with regular intervals of 90°.

Since the first to third injection control side poles 61, 62 and 63 may have the same shape, only the third injection control side pole 63 will be described. As shown in FIG. 3, the third injection control side pole 63 extends along the axis C of the plug body 51. The end portion 60 of the third injection control side pole 63 is radially inwardly angled with respect to the plug body 51. The end portion 60 of the third injection control side pole 63 is designed to be out of contact with the end portion 53*a* of the ground electrode 53.

The end portions 60 of the first and second injection control side poles 61 and 62 are angled in the same way as the end portion 60 of the third injection control side pole 63.

As shown in FIG. 2, the width W1 of the first to third injection control side poles 61, 62 and 63 along the circumference of the center electrode 52 is substantially equal to the width W2 of the ground electrode 53 along the circumference of the center electrode 52. Further, as shown in FIG. 3, the length L2 of the ground electrode 53 along the axis C of the plug body 51 is substantially equal to the length L1 of the first to third injection control side poles 61, 62 and 63 along the axis C of the plug body 51.

Accordingly, the tip 53*b* of the ground electrode 53, and the tip 60*a* of the first to third injection control side poles 61, 62 and 63 are substantially positioned on a single first virtual plane 71 that is perpendicular to the axis C of the plug body 51. The tip 53*b* is the tip of the ground electrode 53 on the axis C. The tip 60*a* is the tip of the first to third injection control side poles 61, 62 and 63 on the axis C of the plug housing 51.

Figure 4:
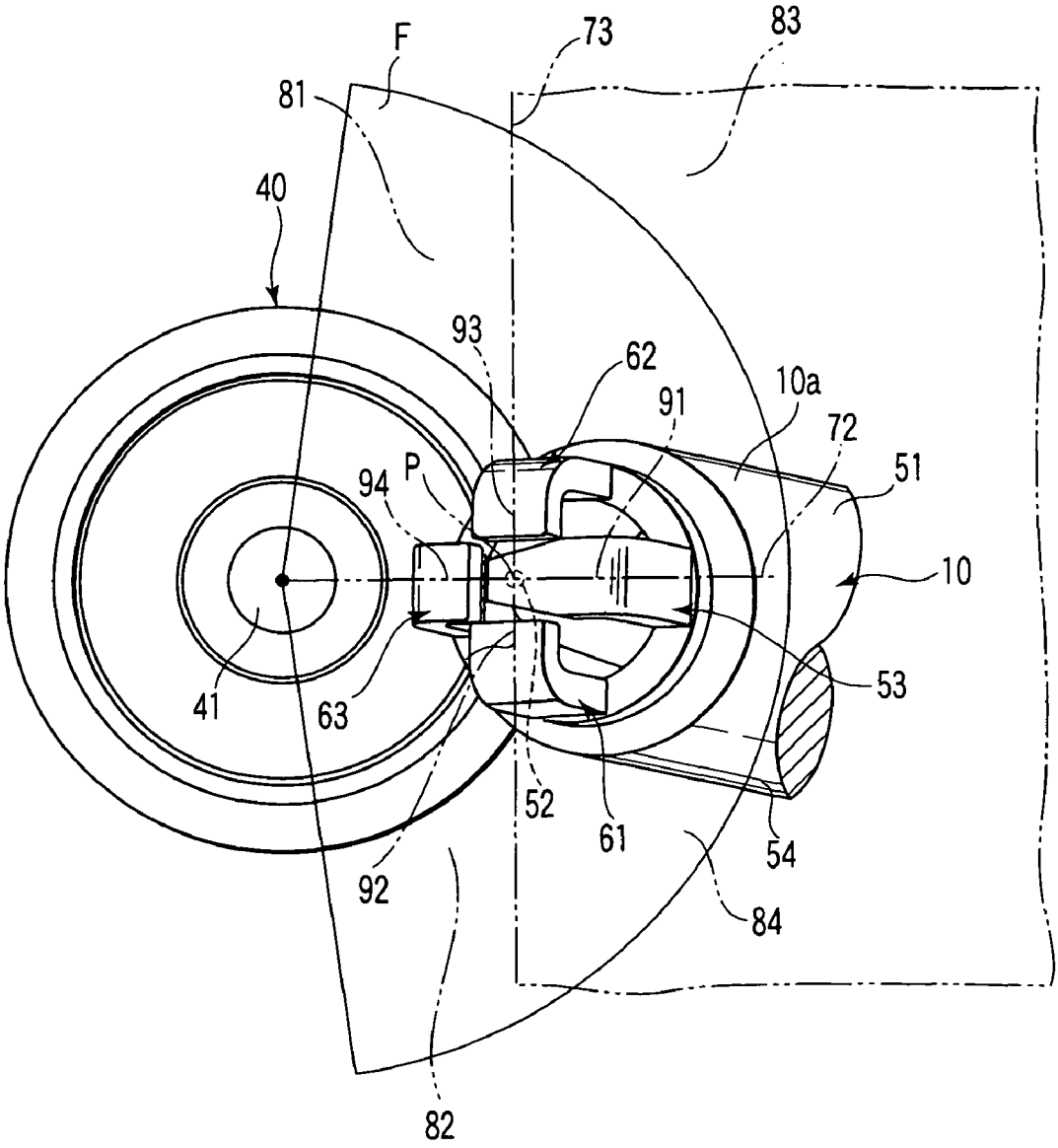
FIG. 4 is a perspective view illustrating a state, viewed along the axis of an injector, in which fuel is injected from the injector when the spark plug of FIG. 1 assumes a first attitude.

The attitude of the spark plug 10 will now be described in detail. FIG. 4 is a perspective view taken when the injector 40 and spark plug 10 are viewed from the cylinder 23 side. In FIG. 4, components, such as the intake valve 28 or exhaust valve 29, are omitted.

As shown in FIG. 4, a second virtual plane 72 and third virtual plane 73 are set. The second virtual plane 72 passes the center of the injection port 41 of the injector 40 and the axis C. The third virtual plane 73 passes the axis C of the plug body 51 and is perpendicular to the second virtual plane 72.

A first virtual region 81, second virtual region 82, third virtual region 83 and fourth virtual region 84, which are defined by the second and third virtual planes 72 and 73, are set.

The first virtual region 81 is the upper left region in the figure. The second virtual region 82 is the lower left region in the figure. The third virtual region 83 is the upper right region in the figure. The fourth virtual region 84 is the lower right region in the figure.

The screw portion 56 of the spark plug 10 is screwed into the female screw portion 22*d*, whereby the spark plug 10 is fixed to the cylinder head 22.

Therefore, the attitudes of the ground electrode 53 and injection control side poles 61, 62 and 63 are varied by the attached state of the spark plug 10, i.e., by the state of rotation of the spark plug 10 relative to the cylinder head 22.

The spark plug 10 can have the following first and second attitudes relative to the injector 40.

The first attitude will now be described. First to fourth virtual lines 91, 92, 93 and 94 are firstly set.

The first virtual line 91 passes the widthwise center of the ground electrode 53 along the circumference of the center electrode 52, and the intersection P of the first virtual plane 71 and the axis C. The second virtual line 92 passes the widthwise center of the first injection control side pole 61 along the circumference of the center electrode 52, and the intersection P. The third virtual line 93 passes the widthwise center of the second injection control side pole 62 along the circumference of the center electrode 52, and the intersection P. The fourth virtual line 94 passes the widthwise center of the third injection control side pole 63 along the circumference of the center electrode 52, and the intersection P.

Accordingly, the first and fourth virtual lines 91 and 94 are the same line, and the second and third virtual lines 92 and 93 are the same line.

The first attitude means that each of the first to fourth virtual lines 91, 92, 93 and 94 is on the second or third virtual plane 71 or 72.

As an example of the first attitude, the first and fourth virtual lines 91 and 94 are positioned on the second virtual plane 72, and the second and third virtual lines 92 and 93 are positioned on the third virtual plane 73, as is shown in FIG. 4.

Alternatively, as an example of the first attitude, the spark plug 10 assumes a state (not shown) in which it is rotated through 90° about the axis C from the state of FIG. 4. In this case, for example, the second and third virtual lines 92 and 93 may be positioned on the second virtual plane 72, and the first and fourth virtual lines 91 and 94 are positioned on the third virtual plane 73.

FIG. 4 shows one of the above-mentioned first attitude states, in which the third injection control side pole 63 is positioned closer to the injector 40 than the ground electrode 53, and the first and second virtual lines 91 and 94 are positioned on the second virtual plane 72.

The second attitude means a state in which each of the first to fourth virtual lines 91, 92, 93 and 94 can be positioned in an arbitrary one of the first to fourth virtual regions 81, 82, 83 and 84, and one virtual line is always positioned in one virtual region.

Figure 5:
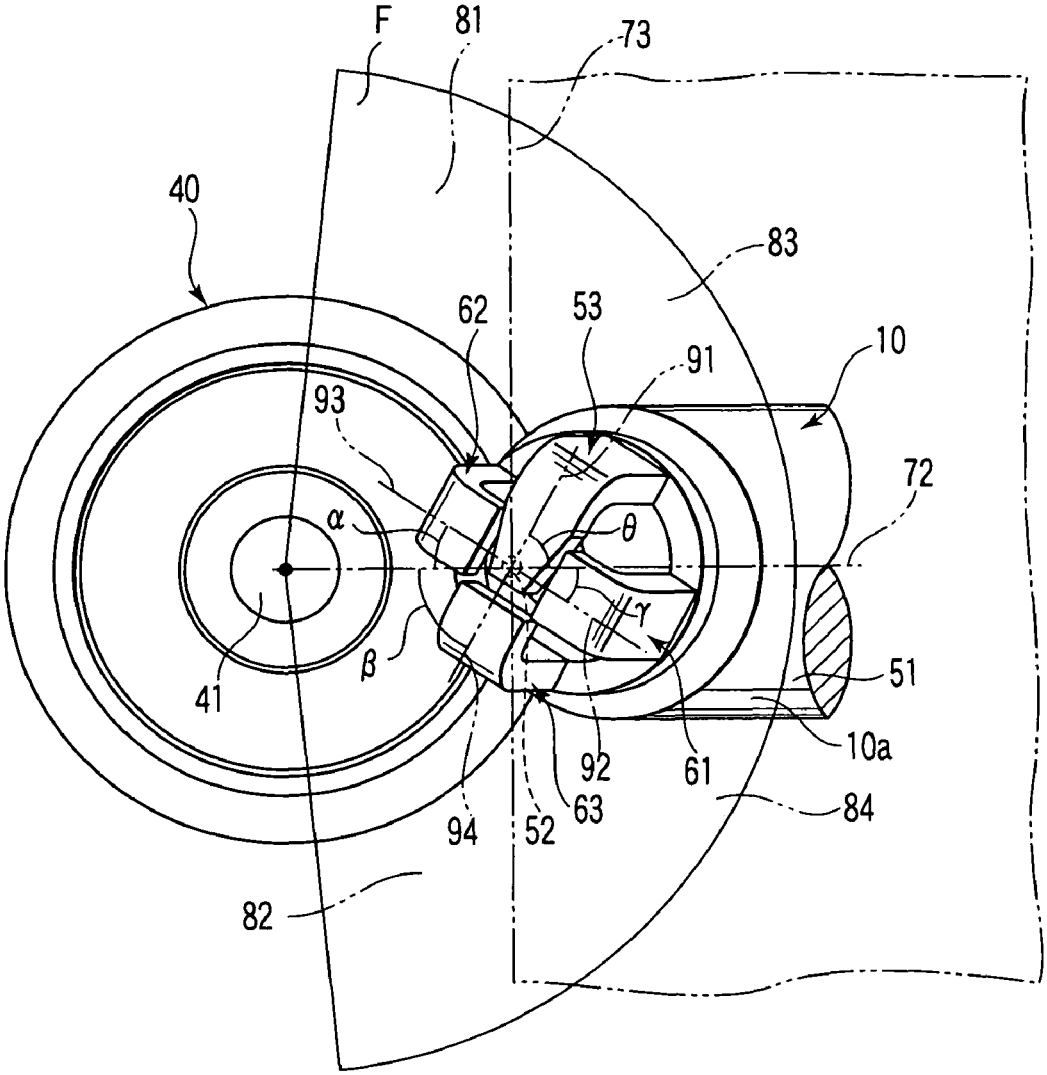
FIG. 5 is a perspective view illustrating a state, viewed along the axis of the injector, in which fuel is injected from the injector when the spark plug of FIG. 1 assumes a third attitude.

FIG. 5 is a perspective view taken when the injector 40 and spark plug 10 are viewed from the cylinder 23 side, illustrating an example of the second attitude. Also in FIG. 5, components, such as the intake valve 28 or exhaust valve 29, are omitted.

In the example of FIG. 5, the first, second, third and fourth virtual lines 91 and 94 are positioned in the third, fourth, first and second virtual regions 83, 84, 81 and 82, respectively.

As another example of the second attitude, the first, third, fourth and second virtual lines 91, 93, 94 and 92 may be positioned in the first, second, fourth and third virtual regions 81, 82, 84 and 83, respectively.

In the second attitude shown in FIG. 5, the angle α between the second virtual plane 72 and the third virtual line 93 is approx. 45°. The angle β between the second virtual plane 72 and the fourth virtual line 94 is also approx. 45°. The angle θ between the second virtual plane 72 and the first virtual line 91 is approx. 45°. The angle γ between the second virtual plane 72 and the second virtual line 92 is approx. 45°.

Each pair of adjacent ones of the first to fourth virtual lines 91, 92, 93 and 94 is perpendicular to each other. Accordingly, in the second attitude, in the first and second virtual regions 81 and 82, the angle between one of the first to fourth virtual lines 91, 92, 93 and 94 and the second virtual plane 72 is not more than 45°.

For instance, in FIG. 5, if the angle α between the third virtual line 93 and the second virtual plane 72 is 50°, the angle β between the second virtual plane 72 and the fourth virtual line 94 is 40°. Similarly, if the angle α between the third virtual line 93 and the second virtual plane 72 is 80°, the angle β between the second virtual plane 72 and the fourth virtual line 94 is 10°.

Thus, in the second attitude, in the first and second virtual regions 81 and 82, the angle between one of the first to fourth virtual lines 91, 92, 93 and 94 and the second virtual plane 72 is not more than 45°.

If, in the second attitude, the angle between each of the virtual lines 91, 92, 93 and 94 and the second virtual plane 72 is 45° as shown in FIG. 5, this state is set as a third attitude.

In the second attitude, the first to fourth virtual lines 91, 92, 93 and 94 can be positioned in an arbitrary one of the first to fourth virtual regions 81, 82, 83 and 84, and one virtual line is always positioned in one virtual region.

Accordingly, a part of the ground electrode 53, or a part of the first to third injection control side poles 61, 62 and 63 is positioned closer to the injector 40 than to the center electrode 52. Namely, the part of the ground electrode 53, or the part of the first to third injection control side poles 61, 62 and 63 is positioned in the first and second virtual regions 81 and 82, and is therefore positioned closer to the injector 40 than to the spark plug 10.

Figure 6:
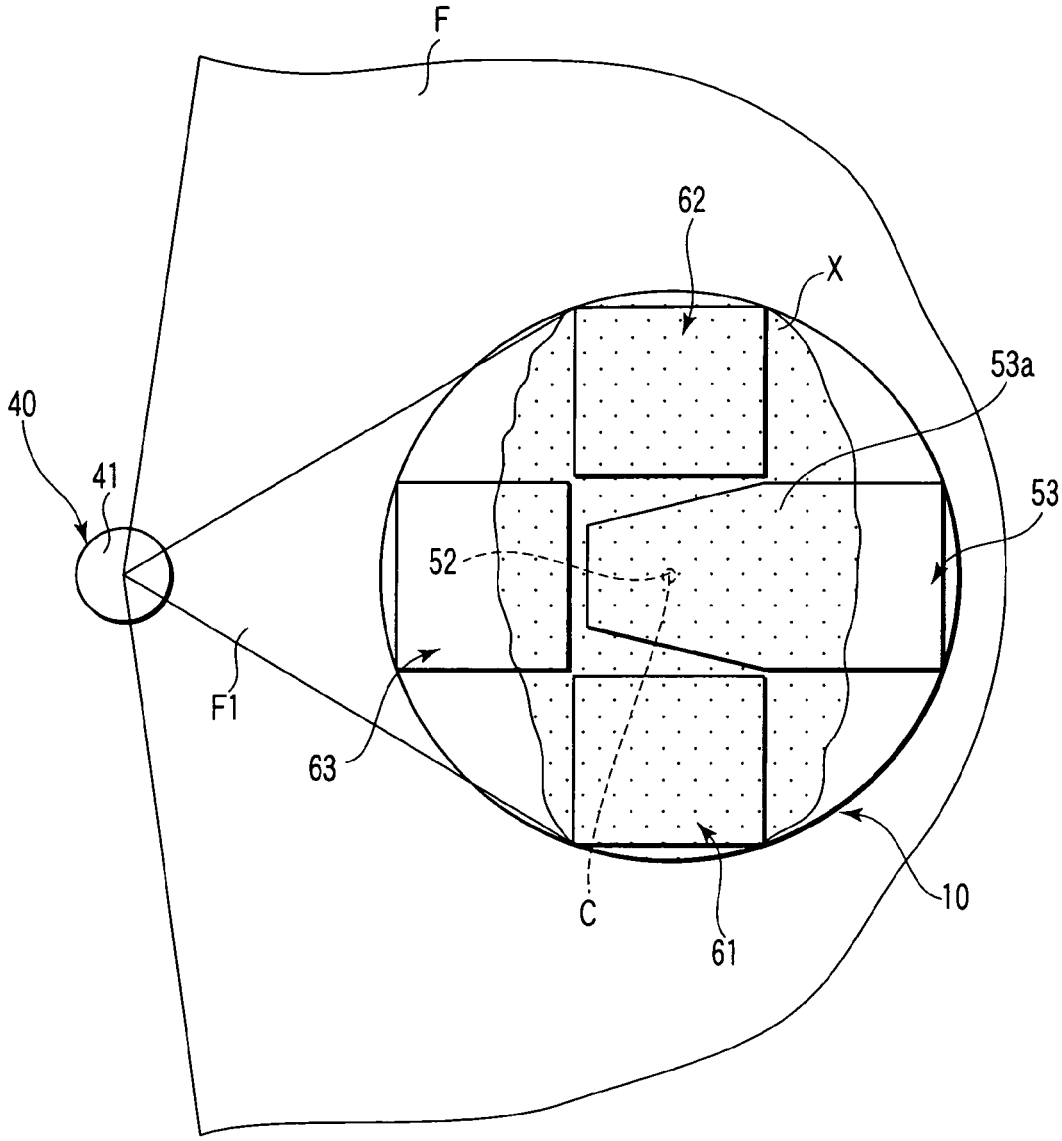
FIG. 6 is a plan view illustrating a state, viewed along the axis of the injector, in which fuel injected from the injector is concentrated around the center electrode shown in FIG. 4.

The operation of the spark plug 10 will now be described. FIG. 6 is a plan view illustrating a state in which fuel F is injected from the injector 40 when the spark plug 10 assumes the first attitude shown in FIG. 4 with respect to the injector 40. FIG. 6 shows the end of the spark plug 10 viewed along the axis C.

As shown in FIGS. 4 and 6, the injector 40 injects fuel F to the spark plug 10. As shown in FIG. 6, fuel F1 included in the fuel F injected from the injector 40 mainly collides with the first and second injection control poles 61 and 62 and hence diffuses, whereby mixing of the fuel and air is accelerated. Thus, the fuel loses its kinetic energy and is concentrated around the center electrode 52.

Note that the range indicated by X is where the fuel F1 mixed with air is concentrated.

The injection port 41 of the injector 40 is designed so that the injected fuel F is mainly applied to the end portion 53*a* of the ground electrode 53 or to the end portions 60 of the first to third injection control side poles 61, 62 and 63. Accordingly, the range X, in which the fuel F1 is concentrated, ranges between the end of the center electrode 52, and the end portion 53*a* of the ground electrode 53 opposing the end of the center electrode 52 along the axis C, as is shown in FIG. 3.

When spark discharge occurs between the center electrode 52 and the end portion 53*a* of the ground electrode 53, the mixture of the fuel F and air is ignited.

Figure 7:
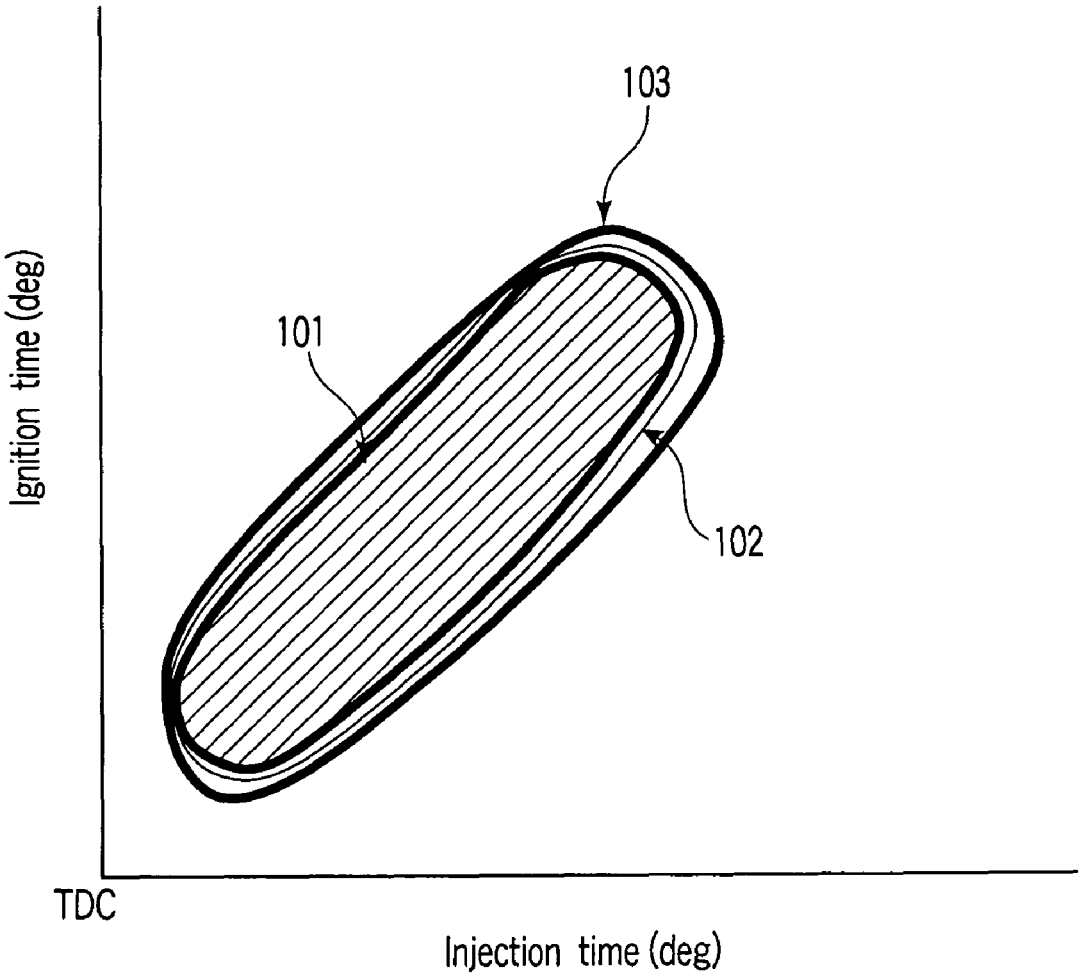
FIG. 7 is a graph illustrating a stable combustion enabled region for the spark plug.

FIG. 7 is a graph illustrating a stable combustion enabled region for the fuel F. The stable combustion enabled region means an ignition timing range for stably combusting the fuel F. Namely, if the ignition timing of the spark plug 10 falls within the stable combustion enabled region, the fuel F is combusted stably.

As described above, when the fuel F collides with the second and third injection control side poles 62 and 63, mixing of the fuel and air is accelerated and the resultant mixture is concentrated around the center electrode 52. Therefore, in the first attitude, the time until the fuel F is ignited after it is injected is relatively long. Accordingly, the stable combustion enabled region 101 in the first attitude is relatively large.

Figure 8:
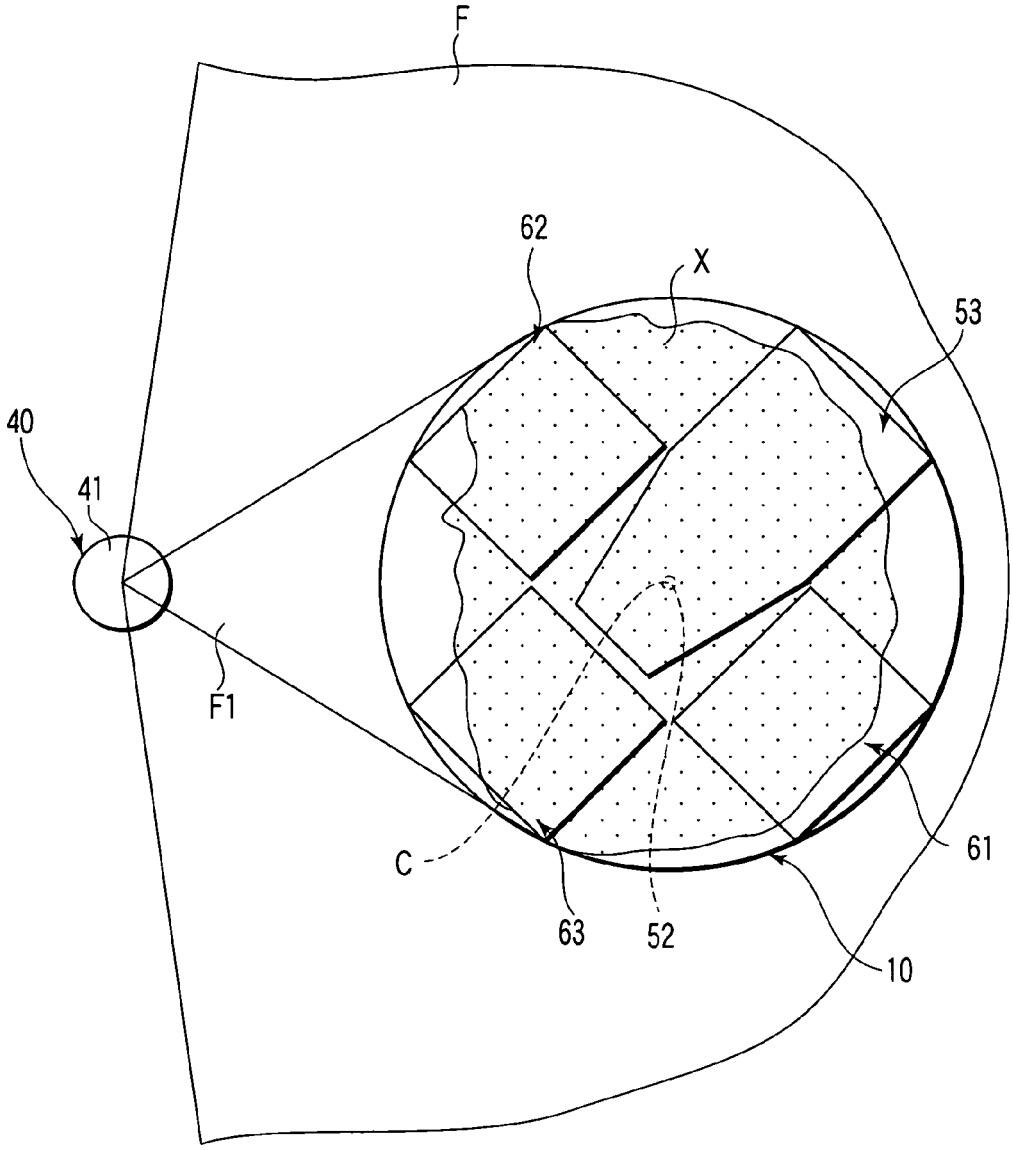
FIG. 8 is a plan view illustrating a state, viewed along the axis of the injector, in which fuel injected from the injector is concentrated around the center electrode shown in FIG. 5.

FIG. 8 is a plan view illustrating a state in which the fuel F is injected from the injector 40 when the spark plug 10 assumes the third attitude shown in FIG. 5 with respect to the injector 40. FIG. 8 shows the end of the spark plug 10 viewed along the axis C.

As shown in FIG. 8, in the third attitude shown in FIG. 5, fuel F1 included in the fuel F injected from the injector 40 mainly collides with the second and third injection control poles 62 and 63 and hence diffuses, whereby mixing of the fuel and air is accelerated. After colliding with the second and third injection control poles 62 and 63, the injected fuel loses its kinetic energy, and is concentrated around the center electrode 52.

Since, in the third attitude, the fuel F is concentrated around the center electrode 52, the time ranging from the injection of the fuel F to the ignition thereof can be set relatively long. Accordingly, as shown in FIG. 7, a stable combustion enabled region 103 in the third attitude is relatively large. In the third attitude, the stable combustion enabled region, in which the ignition timing should fall for stably combusting the fuel F, is larger than the stable combustion enabled region 101.

Figure 9:
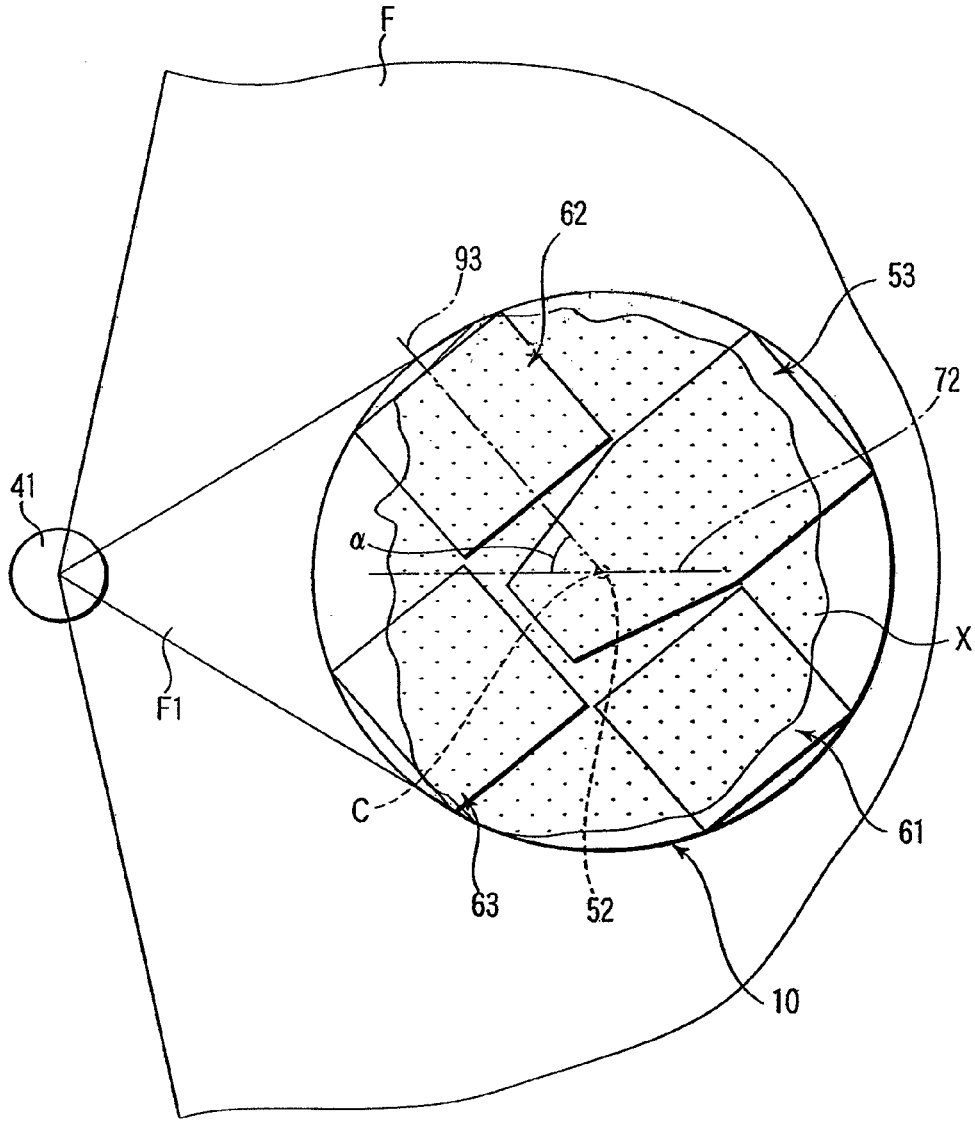
FIG. 9 is a plan view illustrating a state, viewed along the axis of the injector, in which fuel injected from the injector is concentrated around the center electrode, and which is seen when the spark plug of FIG. 1 is in a second attitude excluding a third attitude therefrom.

FIG. 9 is a plan view, taken along the axis C of the spark plug 10, illustrating a state in which the fuel F is injected from the injector 40 when the spark plug 10 assumes the second attitude with respect to the injector 40, and the angle α between the second virtual plane 72 and the third virtual line 93 is, for example, 50°.

As shown in FIG. 9, even in the second attitude except for the third attitude, when the fuel F1 of the fuel F injected from the injector 40 collides with the second and third injection control side poles 62 and 63, it diffuses and its mixing with air is accelerated. The fuel F, which has thus lost its kinetic energy, is concentrated around the center electrode 52.

As shown in FIG. 7, the boundary of a stable combustion enabled region 102 for the second attitude except for the third attitude exists between the boundaries of the stable combustion enabled region 101 for the first attitude and the stable combustion enabled region 103 for the third attitude. Thus, the stable combustion enabled region 102 is relatively large.

As described above, in the embodiment, the stable combustion enabled region 101 for the first attitude is narrowest. From this, it can be understood that even when spark plugs 10 assume different attitudes with respect to the injector 40, i.e., even when one of the spark plugs 10 assumes the first attitude, another spark plug 10 assumes the second attitude except for the third attitude, and the other spark plug 10 assumes the third attitude, the stable combustion enabled region 101 for the first attitude is considered a common stable combustion enabled region.

Regardless of which attitude each spark plug 10 assumes, the injected fuel F collides with the ground electrode 53 or the first to third injection control side poles 61, 62 and 63, whereby it diffuses and is concentrated around the center electrode 52. Thus, the spark plugs 10 according to the invention have a very large stable combustion enabled region, compared to spark plugs including no injection control side poles and a single ground electrode. The stable combustion enabled regions 101, 102 and 103 for the first to third attitudes do not significantly differ from each other.

Namely, since there is no significant difference in stable combustion enabled region between the first, second and third attitudes, the stable combustion enabled region, i.e., combustion conditions, does not significantly vary regardless of which attitude the spark plug 10 assumes with respect to the injector 40.

This advantage is realized by the first to third injection control side poles 61, 62 and 63 of the spark plug 10. The ground electrode 53 and first to third injection control side poles 61, 62 and 63 are arranged at regular intervals. The tips 53*b* and 60*a* of the ground electrode 53 and first to third injection control side poles 61, 62 and 63 are positioned on the first virtual plane 71 that perpendicular to the axis C of the plug body 51.

Accordingly, the fuel F injected from the injector 40 does not collide with the center electrode 52, but collies with one or more of the ground electrode 53 and first to third injection control side poles 61, 62 and 63, whereby it diffuses and its mixing with the air is accelerated. As a result, the fuel F loses its kinetic energy and is concentrated around the center electrode 52.

If the spark plug 10 has no injection control side poles, the injected fuel F, which has collided with the ground electrode 53 and diffused, may not be concentrated around the center electrode 52, depending on the attitude of the spark plug 10 with respect to the injector 40. Even when concentration of the fuel F around the center electrode 52 occurs, the amount of concentrated fuel may well be very small, and accordingly the stable combustion enabled region be very small.

By virtue of the first to third injection control side poles 61, 62 and 63, the fuel F is diffused by them and is appropriately concentrated around the center electrode 52.

This being so, the flammability of the fuel F is enhanced, and the stable combustion enabled region is enlarged. Further, the diffused state of fuel and stable combustion enabled region do not significantly vary regardless of changes in the attitude of the spark plug 10 with respect to the injector 40. As a result, the fuel F can be combusted stably.

In addition, the ground electrode 53, first to third injection control side poles 61, 62 and 63, which are incorporated in the spark plug 10, are positioned around the center electrode 52, spaced by 90° from each other.

Therefore, the attitude of the spark plug 10 relative to the injector 40 is either the first attitude or the second attitude, which means that no significant change is caused in combustion conditions by the attitude of the spark plug 10. The stable combustion enabled region 101 for the first attitude, for example, can be regarded as a common region between different attitudes of the spark plug 10. The stable combustion enabled region 101 for the first attitude is large. Accordingly, even an engine 20 having a plurality of cylinders can have a large common stable combustion enabled region, and hence the fuel F can be combusted stably in the engine.

The end portion 53*a* of the ground electrode 53 is radially inwardly angled with respect to the plug body 51, opposing the center electrode 52 long the axis C. Spark discharge occurs between the center electrode 52 and the end portion 53*a* of the ground electrode 53 in the direction indicated by arrow A.

This means that it is sufficient if the fuel F is concentrated between the end of the center electrode 52 and the end portion 53*a* of the ground electrode 53. The error in the dimension of the spark plug 10, which occurs in the direction indicated by arrow A when the plug is attached, is absorbed by the space defined between the end of the center electrode 52 and the end portion 53*a* of the ground electrode 53. Further, since the end of the ground electrode 53 and the ends of the injection control side poles 61, 62 and 63 are separate from each other, the space defined between the end of the center electrode 52 and the end portion 53*a* of the ground electrode 53 can be easily adjusted. If the spark discharge area of the end of the ground electrode 53 is increased, the cooling loss is increased to thereby degrade the flammability. However, since the end of the ground electrode 53 and the ends of the injection control side poles 61, 62 and 63 are separate from each other, the spark discharge area is not increased, and hence the flammability is not degraded.

Figure 10:
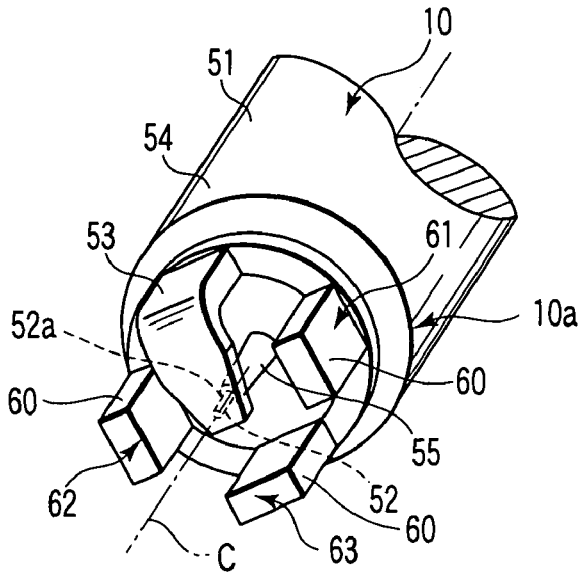
FIG. 10 is a perspective view illustrating the end of a spark plug according to a second embodiment of the invention.
Figure 11:
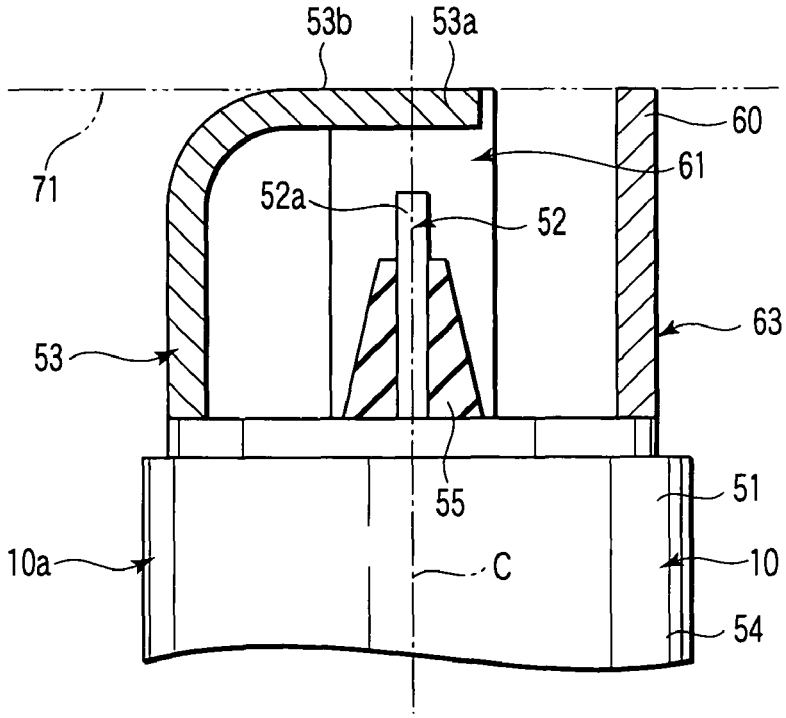
FIG. 11 is a view partly in section, illustrating the end of the spark plug of FIG. 10.

Referring to FIGS. 10 and 11, a description will be given of a spark plug 10 according to a second embodiment of the invention. In this embodiment, elements similar to those employed in the first embodiment are denoted by corresponding reference numbers, and will not be described.

In this embodiment, the shape of the first to third injection control side poles 61, 62 and 63 differs from that in the first embodiment. The other structures may be similar to those of the first embodiment.

The above-mentioned different point will be described in detail. FIG. 10 is a perspective view illustrating the end portion of the spark plug 10. FIG. 11 is a view partly in section, illustrating the end portion 10*a* of the spark plug 10.

As shown in FIGS. 10 and 11, the end portions 60 of the first to third injection control side poles 61, 62 and 63 are not angled and linearly extend along the axis C of the plug body 51.

The second embodiment can provide the same advantage as the first embodiment.

Figure 12:
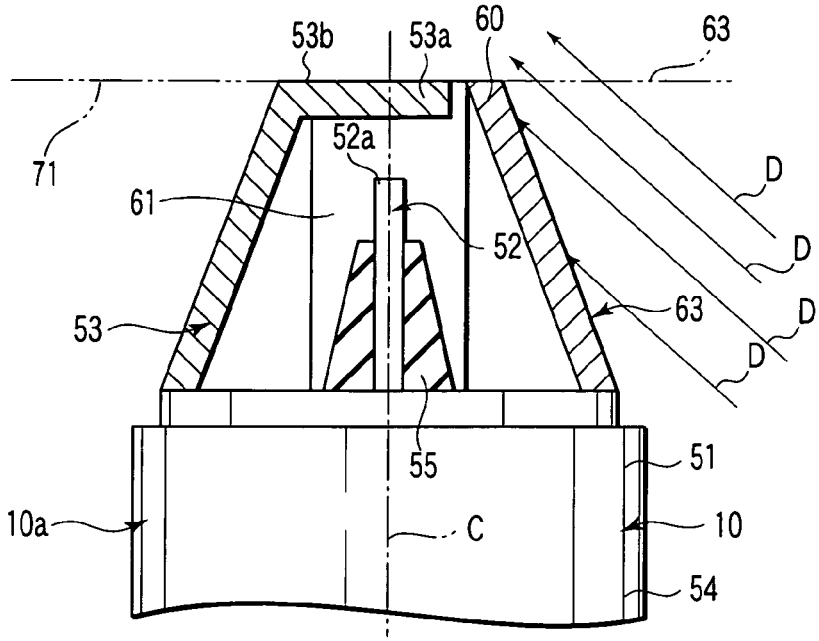
FIG. 12 is a view partly in section, illustrating the end of a spark plug according to a third embodiment of the invention.

Referring then to FIG. 12, a description will be given of a spark plug 10 according to a third embodiment of the invention. In this embodiment, elements similar to those employed in the first embodiment are denoted by corresponding reference numbers, and will not be described.

In this embodiment, the shapes of the ground electrode 53 and injection control side poles 61, 62 and 63 differ from those in the first embodiment. The other structures may be similar to those of the first embodiment. The different point will be described in detail.

FIG. 12 is a view partly in section, illustrating the end portion 10*a* of the spark plug 10. As shown in FIG. 12, the ground electrode 53 and injection control side poles 61, 62 and 63 are radially inwardly inclined with respect to the plug body 51. Namely, the ground electrode 53 and injection control side poles 61, 62 and 63 have a preset inclination with respect to the axis C of the plug body 51.

Further, in FIG. 1, the spark plug 10 is positioned on the right-hand side of the injector 40, and the ends of the ground electrode 53 and injection control side poles 61, 62 and 63 are situated at a lower level than the injection port 41.

Accordingly, the fuel F is obliquely injected from the injection control side poles 63 side to the ground electrode 53 side, as indicated by arrows b in FIG. 12.

Since the ground electrode 53 and injection control side poles 61, 62 and 63 are inclined toward the axis C, a relatively smaller amount of fuel F collides with them.

In other words, the amount of fuel F that collides with the ground electrode 53 and injection control side poles 61, 62 and 63 can be adjusted by adjusting their inclination with respect to the axis C.

Namely, by adjusting the inclination of the ground electrode 53 and injection control side poles 61, 62 and 63 with respect to the axis C, the attitude of the ground electrode 53 and injection control side poles 61, 62 and 63 is changed in a direction D in which the fuel F flows. By this change in attitude, the amount of fuel F that collides with the ground electrode 53 and injection control side poles 61, 62 and 63 is adjusted.

When, for example, a large amount of fuel F is concentrated near the center electrode 52, the inclination of the ground electrode 53 and injection control side poles 61, 62 and 63 with respect to the axis C is adjusted to thereby adjust the amount of fuel F that collides with the ground electrode 53 and injection control side poles 61, 62 and 63.

Specifically, as shown in FIG. 12, the ground electrode 53 and injection control side poles 61, 62 and 63 are radially inwardly inclined with respect to the plug body 51. As a result, the amount of fuel F that collides with the ground electrode 53 and injection control side poles 61, 62 and 63 is reduced.

When the amount of fuel F that collides with the ground electrode 53 and injection control side poles 61, 62 and 63 is reduced, the amount of fuel concentrated around the center electrode 52 is reduced.

This embodiment can provide the same advantage as the first embodiment. Further, by adjusting the inclination of the ground electrode 53 and injection control side poles 61, 62 and 63 with respect to the axis C, the amount of fuel concentrated around the center electrode 52 can be adjusted. Accordingly, the combusting state of the fuel F is further enhanced.

Figure 13:
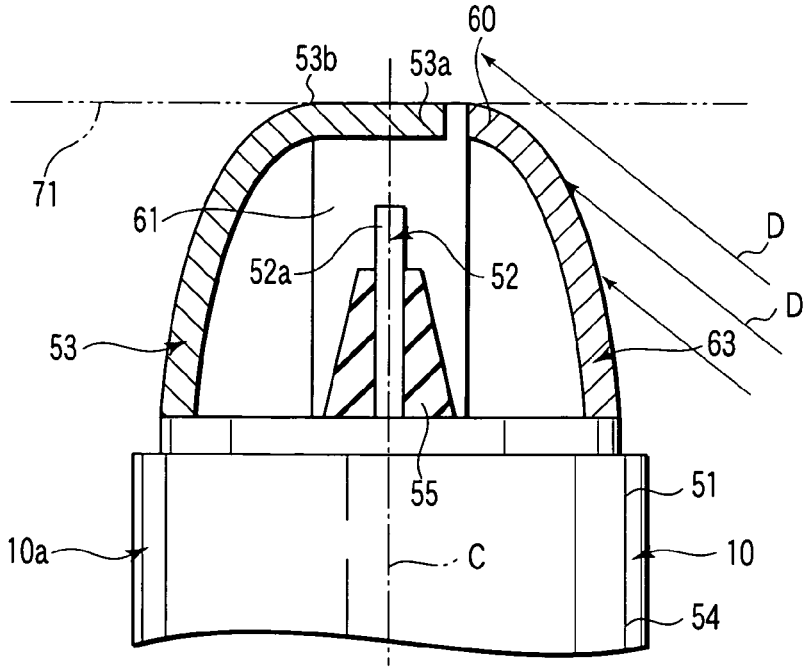
FIG. 13 is a view partly in section, illustrating the end of a spark plug according to a fourth embodiment of the invention.

Referring then to FIG. 13, a description will be given of a spark plug 10 according to a fourth embodiment of the invention. In this embodiment, elements similar to those of the third embodiment will be denoted by corresponding reference numbers, and no description is given thereof.

This embodiment differs from the third embodiment in the shapes of the ground electrode 53 and injection control side poles 61, 62 and 63. The other structures may be similar to those of the third embodiment. The different points will be described in detail.

FIG. 13 is a view partly in section, illustrating the end portion 10*a* of the spark plug 10 of this embodiment. As shown in FIG. 13, the ground electrode 53 and injection control side poles 61, 62 and 63 are radially inwardly smoothly curved above the end portion 52*a* of the center electrode 52 with respect to the plug body.

As described above, the amount of fuel F that collides with the ground electrode 53 and injection control side poles 61, 62 and 63 is adjusted by the curved states of the ground electrode 53 and injection control side poles 61, 62 and 63.

This embodiment can provide the same advantage as the third embodiment.

Although the first to fourth embodiments employ three injection control side poles, the invention is not limited to this. Four or five injection control side poles may be employed.

Further, although in the first to fourth embodiments, the fuel F collides with the first to third injection control side poles 61, 62 and 63 and diffuses, the invention is not limited to this. Even in the first to third attitudes, the ground electrode 53 can assume four positions when it is rotated through 90° about the axis C. Therefore, the ground electrode 53 may be positioned in the first and second virtual regions 81 and 82. In this case, the injected fuel F collides with the ground electrode 53 and diffuses.

Furthermore, although the first to fourth embodiments employ a single ground electrode 53, the invention is not limited to this. A plurality of ground electrodes may be employed.

INDUSTRIAL APPLICABILITY

Since variations in the diffusion of fuel due to changes in the attitude of a spark plug can be suppressed, fuel can be combusted stably.

The invention claimed is:

1. A spark plug, comprising:

a plug body;

a center electrode provided on the plug body coaxially with the plug body;

a ground electrode provided on the plug body in a vicinity of the center electrode, and having a portion opposing an end of the center electrode along an axis of the plug body, a tip of the ground electrode intersecting an axis of the plug body and opposing a tip of the center electrode; and at least one injection control side pole provided on the plug body in the vicinity of the center electrode, a tip of the at least one injection control side pole being separated from the tip of the ground electrode, and the tip of the ground electrode and the tip of the at least one injection control side pole being positioned on substantially the same plane perpendicular to the axis, the ground electrode and the at least one injection control side pole being arranged at substantially regular intervals around the center electrode, wherein a maximum length of the ground electrode along a center axis of the plug body is substantially the same as a maximum length of the at least one injection control side pole along the center axis, and a width of the ground electrode along a circumference of the center electrode is substantially the same as a width of the at least one injection control side pole along the circumference of the center electrode.

2. The spark plug according to claim 1, wherein the at least one injection control side pole includes three injection control side poles.

3. The spark plug according to claim 1, wherein the at least one injection control side pole has a first wall portion that extends along the axis of the plug body and a second wall portion that extends, in a direction perpendicular to the axis of the plug body and toward the axis of the plug body, from an end of the first wall portion, and wherein the second wall portion is positioned on substantially the same plane as the tip of the ground electrode.

4. The spark plug according to claim 1, wherein the at least one injection control side pole is curved towards the axis of the plug body forming a curved surface, and a tip of the curved surface is positioned on substantially the same plane as the tip of the ground electrode.

* * * * *